US010296032B2

(12) United States Patent
Horng et al.

(10) Patent No.: US 10,296,032 B2
(45) Date of Patent: May 21, 2019

(54) BANDGAP REFERENCE CIRCUIT

(71) Applicant: TAIWAN SEMICONDUCTOR MANUFACTURING COMPANY, LTD., Hsinchu (TW)

(72) Inventors: Jaw-Juinn Horng, Hsinchu (TW); Kuo-Feng Yu, Zhudong Township (TW); Chung-Hui Chen, Hsinchu (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 0 days.

(21) Appl. No.: 15/454,684

(22) Filed: Mar. 9, 2017

(65) Prior Publication Data

US 2017/0177017 A1 Jun. 22, 2017

Related U.S. Application Data

(63) Continuation of application No. 13/472,063, filed on May 15, 2012, now Pat. No. 9,612,606.

(51) Int. Cl.
*G05F 3/16* (2006.01)
*G05F 3/30* (2006.01)

(52) U.S. Cl.
CPC . *G05F 3/16* (2013.01); *G05F 3/30* (2013.01)

(58) Field of Classification Search
CPC ..... G05F 3/16; G05F 3/30
USPC ..... 323/313
See application file for complete search history.

(56) References Cited

U.S. PATENT DOCUMENTS 4,224,571 A * 9/1980 Dijkmans ..... H03M 3/02 375/247
5,961,215 A * 10/1999 Lee ..... G01K 7/01 374/178
6,087,683 A * 7/2000 King ..... H01L 29/7378 257/183
6,407,689 B1 * 6/2002 Bazarjani ..... H03M 3/32 341/132
6,680,643 B2 * 1/2004 Conte ..... G05F 3/30 327/539

(Continued)

FOREIGN PATENT DOCUMENTS

WO WO 2012150161 11/2012

OTHER PUBLICATIONS

Received STIC search report from EIC 2800 searcher Patel Samir dated Sep. 13, 2017.*

(Continued)

*Primary Examiner* — Emily P Pham
*Assistant Examiner* — Htet Z Kyaw
(74) *Attorney, Agent, or Firm* — Hauptman Ham LLP

(57) ABSTRACT

A bandgap reference circuit includes a first bipolar junction transistor (BJT) in series with a first current generator, the first BJT and the first current generator configured to produce a first proportional to absolute temperature (PTAT) signal. The circuit also includes a second BJT in series with a second current generator, the second BJT and the second current generator configured to produce a second PTAT signal. The bandgap reference circuit maintains a current through at least one of the first BJT or the second BJT within a constant ideality factor region of the at least one of the first BJT or the second BJT.

20 Claims, 7 Drawing Sheets

(56) References Cited

U.S. PATENT DOCUMENTS 7,514,987 B2 4/2009 Lin
7,821,320 B2 * 10/2010 Ueda ..... G01K 7/20 327/512
7,852,061 B2 12/2010 Liu et al.
7,863,882 B2 1/2011 Harvey
7,880,459 B2 2/2011 Harvey
8,022,751 B2 * 9/2011 Le ..... G05F 3/30 327/539
8,110,835 B2 2/2012 Kumar
8,210,743 B2 * 7/2012 Hasegawa ..... G01K 7/01 327/512
8,330,445 B2 12/2012 Herbst
8,446,140 B2 5/2013 Harvey
8,736,355 B2 * 5/2014 Horng ..... H01L 27/0814 257/197
8,907,351 B2 * 12/2014 Domeij ..... H01L 29/1608 257/77
9,166,067 B2 * 10/2015 Horng ..... H01L 29/8611
9,612,606 B2 * 4/2017 Horng ..... G05F 3/30
9,612,607 B2 * 4/2017 Kumar ..... G05F 3/30
2004/0036460 A1 * 2/2004 Chatal ..... G05F 3/267 323/313
2005/0206362 A1 * 9/2005 Chen ..... G05F 3/30 323/313
2005/0237045 A1 * 10/2005 Lee ..... G05F 3/30 323/313
2007/0052473 A1 * 3/2007 McLeod ..... G05F 3/30 327/539
2007/0296392 A1 12/2007 Chen et al.
2008/0164567 A1 * 7/2008 Lee ..... B82Y 10/00 257/536
2009/0039949 A1 2/2009 Pietrobon
2009/0058391 A1 3/2009 Rokos
2009/0080601 A1 * 3/2009 Tkaczyk ..... G01T 1/249 378/19
2009/0195301 A1 8/2009 Narayanan
2010/0133589 A1 * 6/2010 Aruga ..... H01L 27/0207 257/206
2011/0121809 A1 5/2011 Camacho Galeano et al.
2011/0187445 A1 * 8/2011 Sicard ..... G05F 3/30 327/539
2011/0215789 A1 9/2011 Bouwman et al.
2012/0043955 A1 * 2/2012 Hu ..... G05F 3/30 323/313
2013/0120930 A1 * 5/2013 Temkine ..... G06F 1/206 361/679.47
2013/0144549 A1 * 6/2013 Temkine ..... G01K 7/01 702/99
2013/0328614 A1 * 12/2013 Horng ..... H01L 27/0207 327/512
2014/0077230 A1 * 3/2014 Horng ..... H01L 29/8611 257/77
2015/0054487 A1 2/2015 Kochkin
2016/0290873 A1 * 10/2016 Horng ..... G01R 31/2874

OTHER PUBLICATIONS

Received STIC search report from EIC 2800 searcher Mesfin Getaneh dated Jun. 13, 2018.*
Phili K. T. Mok; et al., "Design Considerations of Recent Advanced Lowe-Voltage Low-Temperature-Coefficient CMOS Bandgap Voltage Reference", IEEE 2004 Custom Integrated Circuits Conference, pp. 635-642.

* cited by examiner

BANDGAP REFERENCE CIRCUIT

PRIORITY CLAIM

The present application is a continuation of U.S. application Ser. No. 13/472,063, filed May 15, 2102, which is incorporated herein by reference in its entirety.

BACKGROUND

Systems, e.g., power management systems such as mixed-signal and radio frequency systems, often use a reference voltage as a basis for comparison and calculation. The systems often include a thermal sensor circuit to monitor the temperature of devices within the systems. In some instances, power management systems include on-chip direct current (DC)-to-DC power converters that provide regulated DC power to other components, such as signal converters. Obtaining high resolution for high speed data conversions, such as analog-to-digital converters and digital-to-analog converters requires a highly accurate reference voltage. The accuracy of the reference voltage often determines a maximum achievable performance of an integrated circuit (IC). In some instances, the reference voltage is produced by a bandgap reference circuit. The reference voltage produced by the bandgap reference circuit does not significantly vary at low-voltage levels and has a low temperature dependency.

For the IC to function as intended, variations in the reference voltage are minimized. The IC includes several potential sources for introducing variations in the reference voltage including error currents associated with current mirrors, edge voltages associated with clamping circuits, and mismatches between transistors and resistors. Circuit designers attempt to minimize the impact from these and other sources of variations. However, the use of low supply voltages in small node, i.e., less than 28 nm, ICs limits the techniques available for circuit designers to adequately control variations in the reference voltage.

BRIEF DESCRIPTION OF DRAWINGS

One or more embodiments are illustrated by way of example, and not by limitation, in the figures of the accompanying drawings, wherein elements having the same reference numeral designations represent like elements throughout. It is emphasized that in accordance with the standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are of course, merely examples and are not intended to be limiting. For example, the formation of a first feature over or on a second feature in the description that follows includes embodiments in which the first and second features are formed in direct contact, and also includes embodiments in which additional features are formed between the first and second features.

Figure 1:
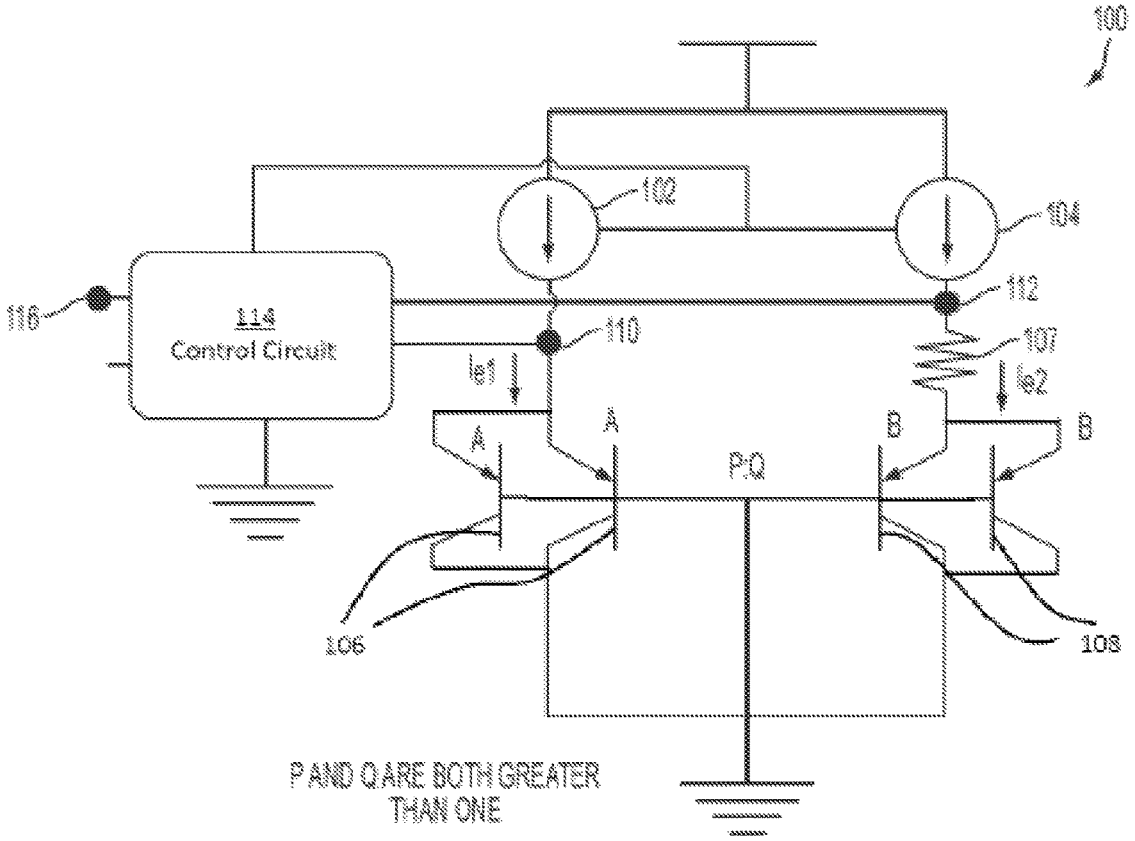
FIG. 1 is a schematic diagram of a proportional to absolute temperature (PTAT) circuit as a bandgap reference circuit in accordance with one or more embodiments.

FIG. 1 depicts a schematic diagram of a proportional to absolute temperature (PTAT) circuit 100 as a bandgap reference circuit, in accordance with one or more embodiments. PTAT circuit includes a first current generator 102, a second current generator 104, a first set of bipolar junction transistors (BJTs) 106, a resistor 107, and a second set of BJTs 108. First current generator 102 is configured to generate a first supply current $I_{e1}$. Second current generator 104 is configured to generate a second supply current $I_{e2}$. The first set of bipolar junction transistors (BJTs) 106 is configured to receive first supply current $I_{e1}$. The second set of BJTs 108 is configured to receive second supply current $I_{e2}$, after second supply current $I_{e2}$ passes through the resistor 107. A control circuit 114 electrically connects to a node 110 between first current generator 102 and first set of BJTs 106 and a node 112 between second current generator 104 and second set of BJTs 108. Control circuit 114 supplies a feedback signal to control the first and second current generators 102 and 104 so that the voltage at nodes 110 and node 112 are equivalent. By controlling the first and second current generators 102 and 104 in such a manner, first supply current $I_{e1}$ will be equal to the second supply current $I_{e2}$. An output 116 electrically connects control circuit 114 to external devices.

When the voltage at nodes 110 and 112 are the same, and the supply currents Ie1 and Ie2 are same, a reference voltage signal is generated by PTAT circuit 100. A first proportional to absolute temperature (PTAT) signal is equal to a voltage drop, VBE1, across the first set of BJTs 106 and a second PTAT signal is equal to a voltage drop, VBE2, across the second set of BJTs 108. The reference voltage signal is equal to the difference of the first PTAT signal and the second PTAT signal. An output of PTAT circuit 100 will produce the reference voltage signal independent of variation in absolute temperature.

First set of BJTs 106 includes a number, P, of transistors A electrically connected in a parallel arrangement. In conventional bandgap reference circuits, the number of transistors in the first set of BJTs is equal to one. However, the number, P for some purpose, of transistors A in first set of BJTs 106 is greater than one. And that will be introduced later.

Second set of BJTs 108 includes a number, Q, of transistors B electrically connected in a parallel arrangement. The number, Q, of transistors B in second set of BJTs 108 is greater than one. In some embodiments, Q is greater than P. In some embodiments, Q is equal to P.

In some embodiments, transistors A and B are positive-negative-positive (PNP) BJTs. In some embodiments, transistors A and B are negative-positive-negative (NPN) BJTs. In some advance processes, for example 20 nm processes, a p-type device channel is doped SiGe to enhance carrier mobility. Hence, in some embodiments, a P+ doped portion of parasitic BJT will be replaced by SiGe material. A P+/NW junction is a homo-junction, however, a SiGe/NW junction changes to a hetero-junction and modifies the ideality factor and linearity of BJT performance. In some embodiments, an n-type channel comprises silicon carbide. In some embodiments, the silicon carbide and the silicon germanium are epitaxially grown.

When the PTAT circuit 100 is part of a semiconductor chip, the first PTAT signal is also used to monitor the temperature of the semiconductor chip. As the temperature of the semiconductor chip increases, the bandgap reference circuit 100 will generate the first PTAT signal $$PTAT=(n_f KT/q)*\ln(m)$$

where $n_f$ is the ideality factor, K is Boltzmann's constant, T is absolute temperature, q is one electronic charge ($1.6\times10^{-19}$ C) and m is the BJT ratio.

Figure 2A:
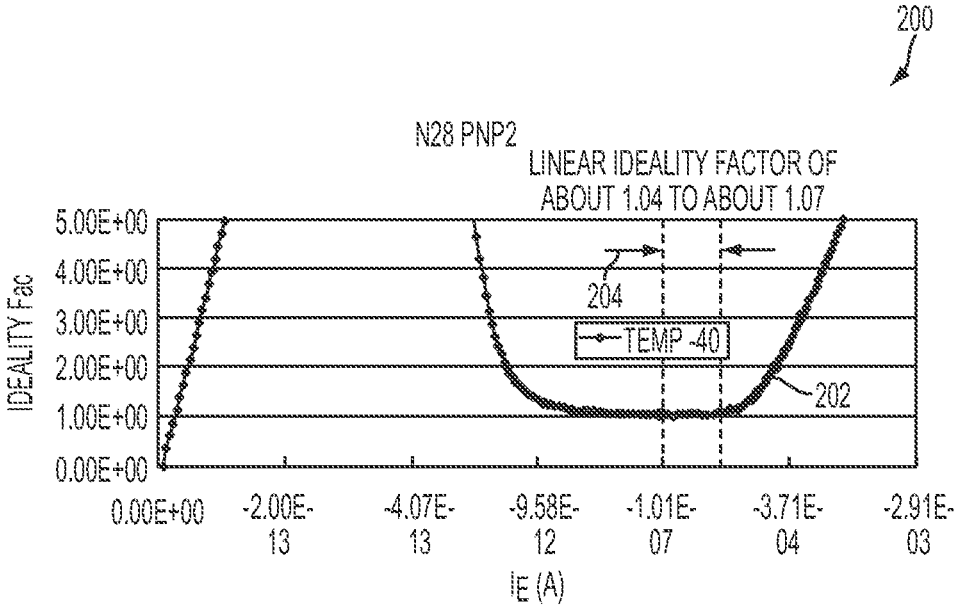
FIGS. 2A and 2B are graphs of an ideality factor of a transistor versus supply current to the transistor in according with one or more embodiments.

FIG. 2A depicts a graph 200 of an ideality factor of a transistor versus a supply current $I_e$ to the transistor at a temperature of −40° C. Curve 202 illustrates the ideality factor is substantially constant at a temperature of −40° C. for a supply current ranging from about 0.1 μA to about 100 μA. The substantially constant portion of curve 202 is called a constant ideality factor region 204. The ideality factor in constant ideality factor region 204 ranges from about 1.04 to about 1.07. Outside the constant ideality factor region 204 small fluctuations in supply current impacts the performance of the transistor. A bandgap reference circuit configured to operate outside constant ideality factor region 204 is more complex and costly to produce than PTAT circuit 100 configured to operate within constant ideality factor region 204.

Figure 2B:
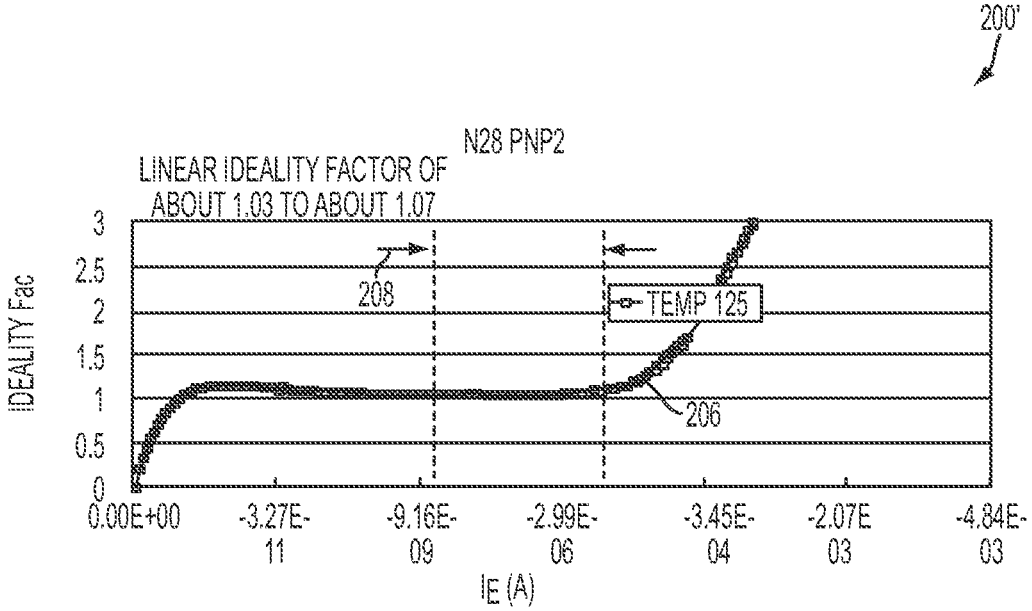

FIG. 2B depicts a graph 200' of an ideality factor of the transistor versus a supply current $I_e$ for the transistor at a temperature of 125° C. Curve 206 illustrates the ideality factor is substantially constant at a temperature of 125° C. for the supply current ranging from about 0.1 μA to about 100 μA. The substantially constant portion of curve 206 is a constant ideality factor region 208 for a temperature of 125° C. The ideality factor in constant ideality factor region 208 ranges from about 1.03 to about 1.07.

Figure 3:
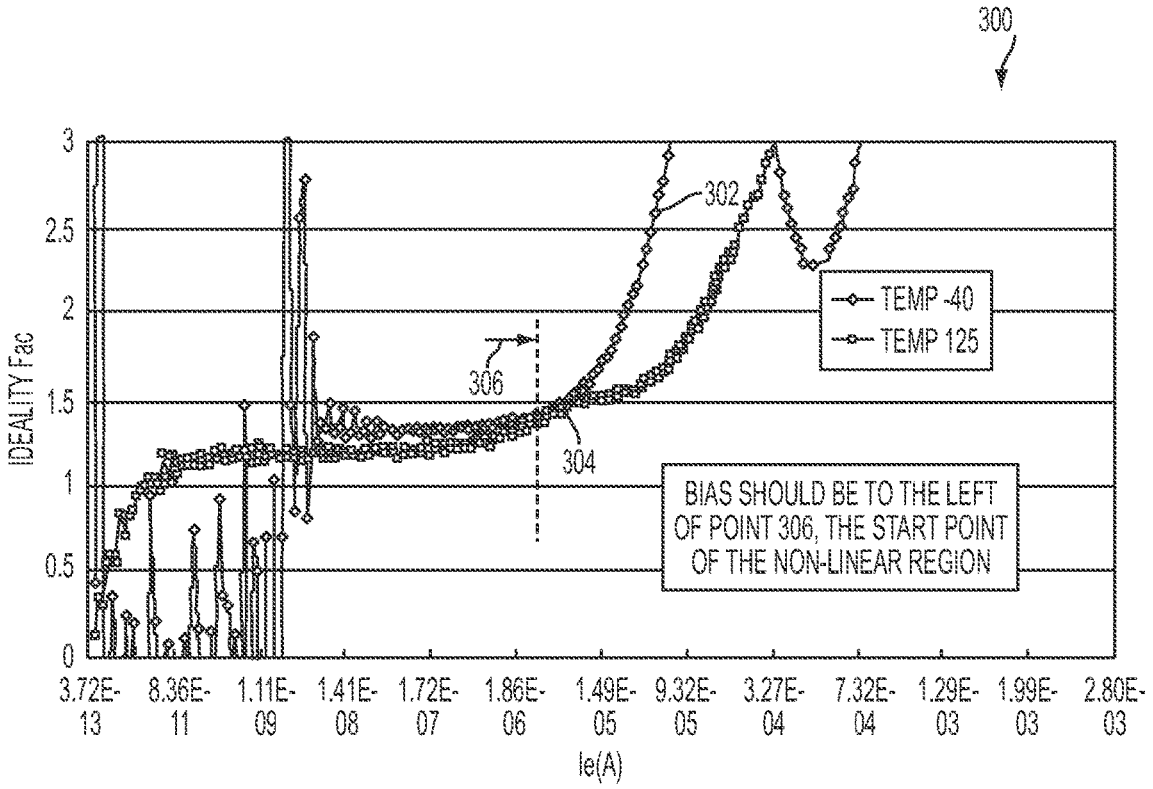
FIG. 3 is a graph of the ideality factor of a transistor versus supply current to the transistor in accordance with one or more embodiments.

FIG. 3 depicts a graph 300 of the ideality factor of the SiGe doping transistor versus supply current $I_e$ for the transistor at temperatures of −40° C. and 125° C. Curve 302 represents the ideality factor of the transistor versus supply current $I_e$ at a temperature −40° C. Curve 304 represents the ideality factor of the transistor versus supply current $I_e$ at a temperature 125° C. Curves 302 and 304 illustrate a constant ideality factor region to the left of point 306. The constant ideality factor region for the graph of FIG. 3 is smaller than 4 μA. In order to operate in the constant ideality factor region, transistors in the bandgap reference circuit have a current bias less than or equal to 4 μA.

Figure 4:
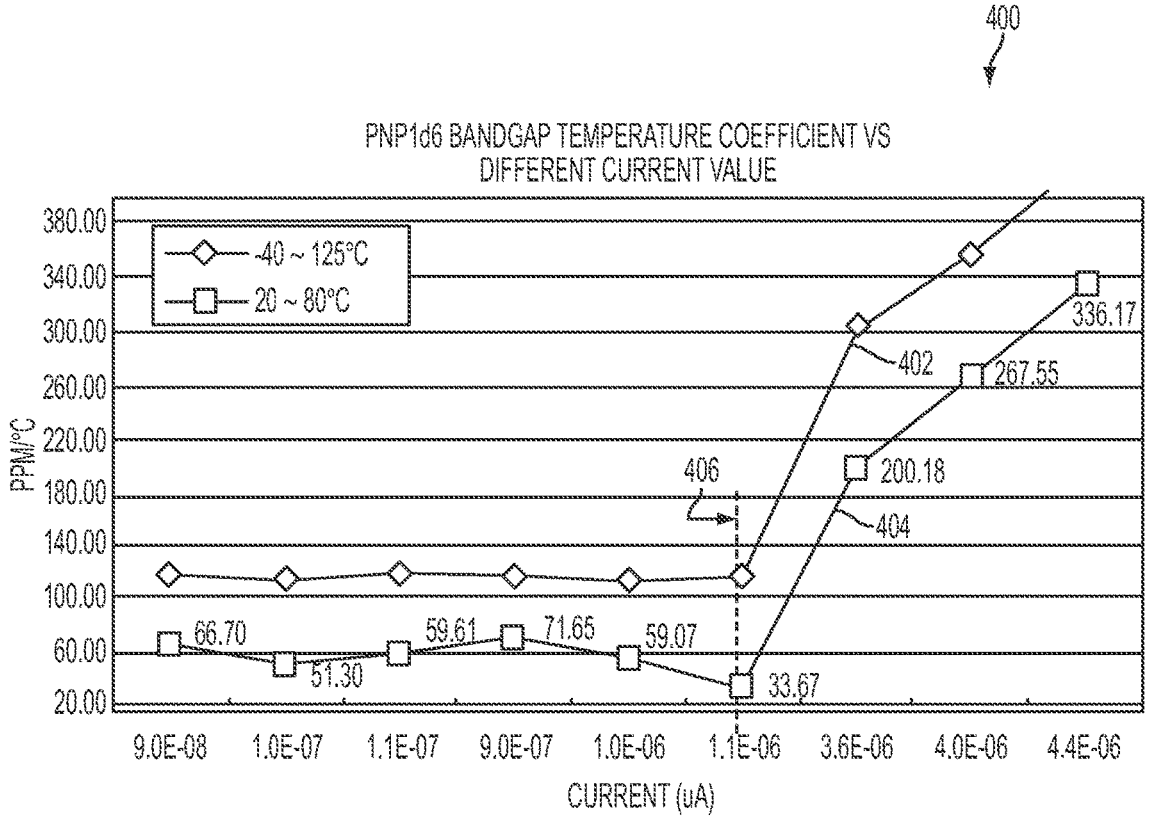
FIG. 4 is a graph of bandgap temperature coefficient for a bandgap reference circuit versus the supply current of the bandgap reference circuit for different temperature ranges in accordance with one or more embodiments.

FIG. 4 is a graph 400 of bandgap temperature coefficient for a bandgap reference circuit versus a supply current to a transistor for different temperature ranges in accordance with one or more embodiments. This bandgap reference circuit was implemented using a SiGe doped transistor (parasitic BJT). Curve 402 represents the temperature coefficient of bandgap reference output versus a supply current $I_e$ in a temperature range from −40° C. to 125° C. Curve 404 represents the temperature coefficient of bandgap reference output versus a supply current $I_e$ in a temperature range from 20° C. to 80° C. Within curves 402 and 404, the temperature coefficient of bandgap reference output remains substantially constant for supply currents to the left of point 406. Point 406 corresponds to a supply current $I_e$ of about 1.1 μA.

However, supply currents of about 1.1 uA cause mismatching between Ie1 and Ie2. In order to operate at a sufficiently large supply current, while maintaining a current in a range of substantially constant temperature coefficient, a number of BJTs is increased. The increased number of BJTs facilitates the use of supply currents to a group of BJTs within a range suitable to avoid mismatches between supply currents, while also reducing the current supplied to individual BJTs within the group.

Figure 5:
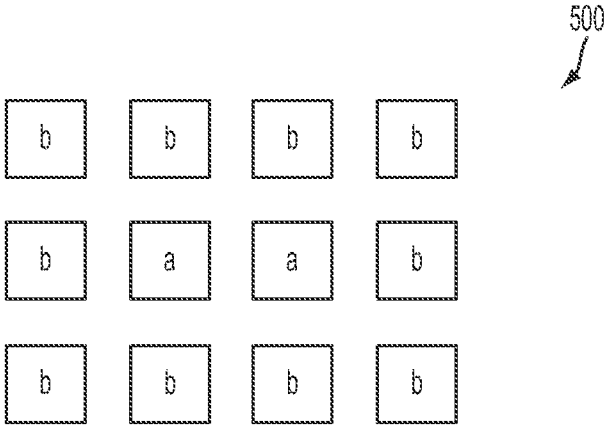
FIG. 5 is a layout of transistors A and B of FIG. 1 in a 3×4 array in accordance with one or more embodiments.

FIG. 5 is a layout 500 of transistors A and B of PTAT circuit 100 in a 3×4 array in accordance with one or more embodiments. In a centroid type pattern, the number, Q, of transistors B is determined by the equation Q=(n+2)×(m+2)−n×m, where n is a number of rows of transistors A, and m is a number of columns of transistor A, The transistors A of first set of BJTs 506 are located in two central locations surrounded by one layer of transistors B of second set of BJTs 508. For layout 500, P equals two (2) and Q equals ten (10). In a conventional bandgap reference circuit, the centroid pattern would include a single transistor A surrounded by a plurality of transistors B. The centroid type pattern including more than one transistor A tolerates an increase in supply current $Ie_1$, while maintaining a sufficiently low supply current to individual transistors.

Figure 6:
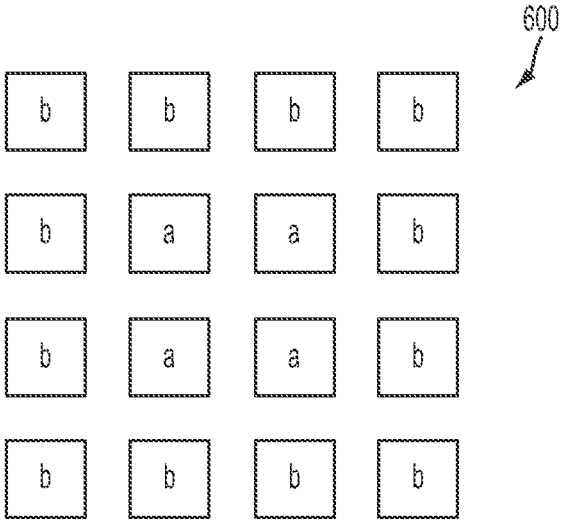
FIG. 6 is a layout of transistors A and B of FIG. 1 in a 4×4 array in accordance with one or more embodiments.

FIG. 6 is a layout 600 of transistors A and B of PTAT circuit 100 in a 4×4 array in accordance with one or more embodiments. The transistors A of first set of BJTs 106 are located in four central locations surrounded by one layer of transistors B of second set of BJTs 108. For layout 600, P equals four (4) and Q equals twelve (12).

Figure 7:
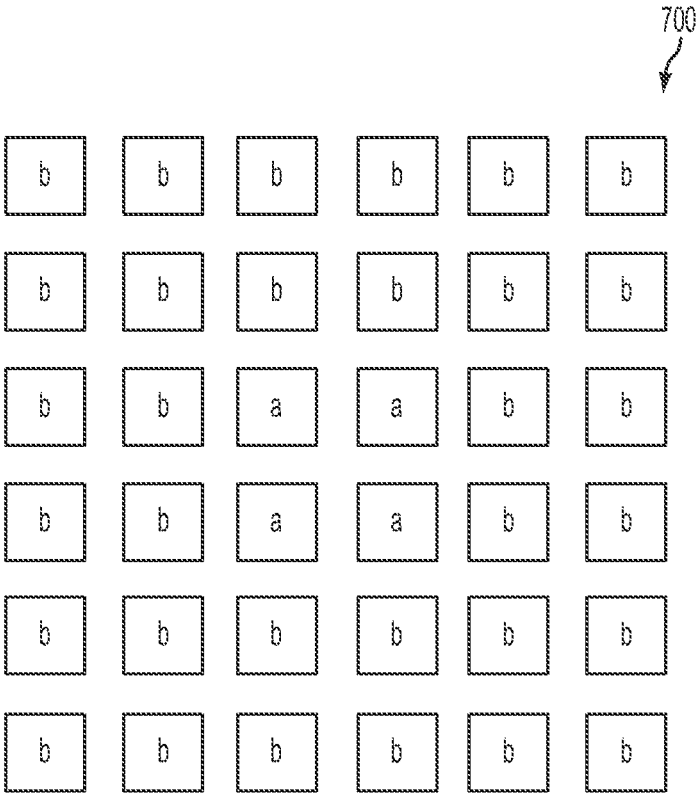
FIG. 7 is a layout of transistors A and B of FIG. 1 in a 6×6 array in accordance with one or more embodiments.

FIG. 7 is a layout 700 of transistors A and B of PTAT circuit 100 in a 6×6 array in accordance with one or more embodiments. The transistors A of the first set of BJTs 106 are located in four central locations surrounded by two layers of transistors B of the second set of BJTs 108. Because the transistors A are surrounded by more than one layer of transistors B layer, in a centroid type pattern, the number, Q, of transistors B is determined by the equation Q=(n+E)×(m+E)−n×m, where n is a number of rows of transistors A, m is a number of columns of transistor A, and E is an even integer equal to or greater than two. The value of E is the number of transistors B separating any transistor A from an exterior of a centroid type pattern layout. Continuing with the above example and an E value selected as two, the ratio of transistors A to transistors B is 4 to 32.

Figure 8A:
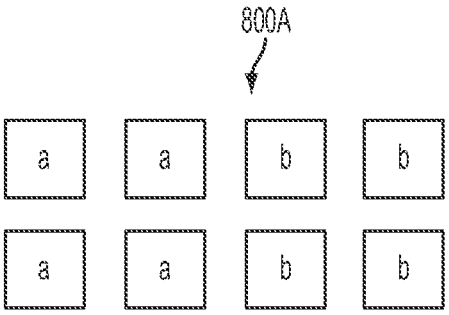
FIGS. 8A and 8B are layouts of transistors A and B of FIG. 1 where the ratio of transistors A:B is 1:1 in accordance with one or more embodiments.
Figure 8B:
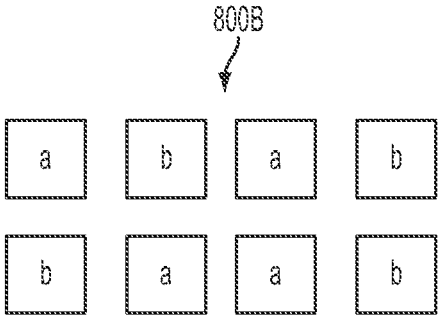

FIGS. 8A and 8B are layouts of transistors A and B of PTAT circuit 100 where the ratio of transistors A:B is 1:1. Supply current $I_{e1}$ to transistor A and supply current $I_{e2}$ to transistor B will have ratio relationship to generate a PTAT signal for temperature sensor applications. Supply currents $I_{e1}$ and $I_{e2}$ for PTAT circuits 100 having a matching layout is higher than for PTAT circuits 100 having a centroid-type layout. However, in order to maintain the individual transistors operating in a current range having a linear ideality factor the number of transistors A and B are increased as well.

FIG. 8A depicts a matching pattern having a 2×2 array of transistors A beside a 2×2 array of transistors B to form a 2×4 array. FIG. 8B depicts a matching pattern in a 2×4 array with transistors A and transistors B arranged in an alternating fashion. In some embodiments, transistors A and transistors B are arranged in different arrangements having a ratio of transistors A to transistors B of 1:1.

Figure 9:
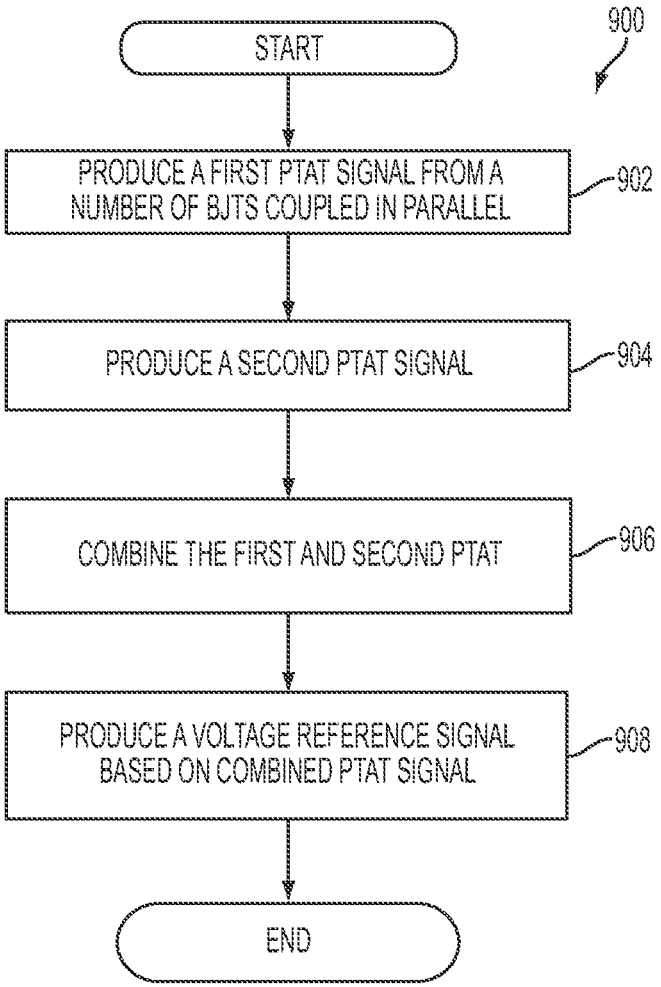
FIG. 9 is a logic flow diagram associated with a method of generating a reference voltage by a bandgap reference circuit in accordance with one or more embodiments.

FIG. 9 is a logic flow diagram associated with a method 900 of generating a reference voltage by a bandgap reference circuit.

In step 902, a first PTAT signal is produced by a first set of BJTs configured to electrically connect in a parallel arrangement. Lower supply currents reduce ideality factor fluctuations based on temperature changes of the BJT. Also as depicted in graphs 200 and 200', a BJT having a supply current in a range from about 0.1 μA to about 20 μA functions in a linear ideality factor region.

In block 904, a second PTAT signal is produced by a second set of BJTs. The second set of BJTs is configured to electrically connect in a parallel arrangement, similar to the first set of BJTs.

In block 906, a circuitry combines the first PTAT signal and second PTAT signal to produce a reference voltage. In some embodiments, circuitry 114 is configured to produce the reference voltage by adding the first PTAT signal combined with suitable multiplication constants and the second PTAT signal combined with suitable multiplication constants. Because the first PTAT signal and the second PTAT signal have temperature coefficients of opposite signs, the resulting reference voltage is independent of temperature.

In some embodiments, a bandgap reference circuit includes a first BJT in series with a first current generator, the first BJT and the first current generator being configured to produce a first PTAT signal. The circuit further includes a second BJT in series with a second current generator, the second BJT and the second current generator being configured to produce a second PTAT signal. The bandgap reference circuit is configured to maintain a current through at least one of the first BJT or the second BJT within a constant ideality factor region of the at least one of the first BJT or the second BJT.

In some embodiments, a bandgap reference circuit is configured to produce a reference voltage signal from a first PTAT signal and a second PTAT signal. The bandgap reference circuit includes a first current generator configured to output a first supply current, a second current generator configured to output a second supply current, a first BJT in series with the first current generator and configured to produce the first PTAT signal based on the first supply current, and a second BJT in series with the second current generator and configured to produce the second PTAT signal based on the second supply current. The bandgap reference circuit is configured to maintain emitter currents through each of the first BJT and the second BJT within a constant ideality factor region of the corresponding first BJT or second BJT.

In some embodiments, a method of generating a reference voltage signal includes generating a first supply current using a first current generator, generating a second supply current using a second current generator, and, using a first BJT, generating a first PTAT signal from a portion of the first supply current, the portion of the first supply current corresponding to a constant ideality factor region of the first BJT. The method further includes, using a second BJT, generating a second PTAT signal from a portion of the second supply current, the portion of the second supply current corresponding to a constant ideality factor region of the second BJT, and outputting the reference voltage signal based on the first PTAT signal and the second PTAT signal.

While the description is presented by way of examples and in terms of specific embodiments, it is to be understood that the invention is not limited to the disclosed embodiments. To the contrary, it is intended to cover various modifications and similar arrangements (as would be apparent to those skilled in the art). The above description discloses exemplary steps, but they are not necessarily required to be performed in the order described. Steps can be added, replaced, change in order, and/or eliminated as appropriate, in accordance with the spirit and scope of the description. Embodiments that combine different claims and/or different embodiments are within the scope of the description and will be apparent to those skilled in the art after reviewing this disclosure. Therefore, the scope of the appended claims should be accorded the broadest interpretation so as to encompass all such modifications and similar arrangements.

What is claimed is:

1. A bandgap reference circuit, comprising:

a plurality of first bipolar junction transistors (BJTs) arranged in parallel and in series with a first current generator, wherein the plurality of first BJTs and the first current generator are configured to produce a first proportional to absolute temperature (PTAT) signal; and a plurality of second BJTs arranged in parallel and in series with a second current generator, wherein the plurality of second BJTs and the second current generator are configured to produce a second PTAT signal, wherein the bandgap reference circuit is configured to maintain a current through at least a first BJT of the plurality of first BJTs or a second BJT of the plurality of second BJTs within a constant ideality factor region of the first BJT of the plurality of first BJTs or of the second BJT of the plurality of second BJTs, and the plurality of first BJTs and the plurality of second BJTs are positioned in an array, and at least one row or column of the array comprises two first BJTs of the plurality of first BJTs and two second BJTs of the plurality of second BJTs.

2. The bandgap reference circuit of claim 1, wherein the bandgap reference circuit is configured to maintain the current through the first BJT or the second BJT within a range from about 0.1 microampere (μA) to about 100 μA.

3. The bandgap reference circuit of claim 1, wherein the constant ideality factor region of the first BJT or the second BJT corresponds to an ideality factor ranging from about 1.03 to about 1.07.

4. The bandgap reference circuit of claim 1, wherein:

the first BJT or the second BJT comprises an epitaxial SiGe layer, and the bandgap reference circuit is configured to maintain the current through the first BJT or the second BJT at or below about 4 μA.

5. The bandgap reference circuit of claim 4, wherein the constant ideality factor region of the first BJT or the second BJT corresponds to an ideality factor between 1.0 and 1.5.

6. The bandgap reference circuit of claim 1, wherein:

a total current through the plurality of first BJTs matches a first supply current output by the first current generator; and a total current through the plurality of second BJTs matches a second supply current output by the second current generator.

7. The bandgap reference circuit of claim 1 wherein:

the array comprises the plurality of second BJTs surrounding the plurality of first BJTs in a centroid pattern, and a number Q of BJTs of the plurality of second BJTs is defined by $Q=(n+E)\times(m+E)-n\times m$, where n is a number of rows of BJTs of the plurality of first BJTs, m is a number of columns of BJTs of the plurality of first BJTs, and E is an even integer equal to the number of BJTs of the plurality of second BJTs separating any BJT of the plurality of first BJTs from an exterior of the array.

8. The bandgap reference circuit of claim 1 wherein a number of BJTs of the plurality of first BJTs is equal to a number of BJTs of the plurality of second BJTs.

9. The bandgap reference circuit of claim 8, wherein the plurality of first BJTs and the plurality of second BJTs are collectively arranged in a matching pattern in the array.

10. The bandgap reference circuit of claim 1, wherein:

a first circuit branch comprising the first BJT in series with the first current generator is arranged in parallel with a second circuit branch comprising the second BJT in series with the second current generator, the first PTAT signal has a first temperature coefficient of a first sign, and the second PTAT signal has a second temperature coefficient of a second sign, the second sign being opposite the first sign, and the bandgap reference circuit is configured to generate a reference voltage signal by adding the first PTAT signal and the second PTAT signal.

11. A bandgap reference circuit configured to produce a reference voltage signal from a first proportional to absolute temperature (PTAT) signal and a second PTAT signal, the bandgap reference circuit comprising:

a first current generator configured to output a first supply current;

a second current generator configured to output a second supply current;

a plurality of first bipolar junction transistors (BJTs) in series with the first current generator and configured to produce the first PTAT signal based on the first supply current; and a plurality of second BJTs in series with the second current generator and configured to produce the second PTAT signal based on the second supply current, wherein the bandgap reference circuit is configured to maintain emitter currents through a first BJT of the plurality of first BJTs and a second BJT of the plurality of second BJTs within a constant ideality factor region of the corresponding first BJT or second BJT, and the plurality of first BJTs and the plurality of second BJTs are positioned in an array, and at least one row or column of the array comprises two first BJTs of the plurality of first BJTs and two second BJTs of the plurality of second BJTs.

12. The bandgap reference circuit of claim 11, wherein:

each of the first BJT and the second BJT comprises a hetero junction including epitaxial SiGe; and the bandgap reference circuit is configured to maintain the emitter currents through each of the first BJT and the second BJT at or below about 4 microampere (μA).

13. The bandgap reference circuit of claim 12, wherein each of the first BJT and the second BJT is a parasitic BJT of a p-type device.

14. The bandgap reference circuit of claim 12, wherein:

the bandgap reference circuit is configured to maintain the emitter currents through each first BJT of the plurality of first BJTs and each second BJT of the plurality of second BJTs at or below about 4 μA by dividing a corresponding one of the first supply current or second supply current among the corresponding plurality of first BJTs or plurality of second BJTs.

15. A method of generating a reference voltage signal, the method comprising:

generating a first supply current using a first current generator;

generating a second supply current using a second current generator;

using a first bipolar junction transistor (BJT) of a first plurality of BJTs connected in parallel, generating a first proportional to absolute temperature (PTAT) signal from a portion of the first supply current, the portion of the first supply current corresponding to a constant ideality factor region of the first BJT;

using a second BJT of a second plurality of BJTs connected in parallel, generating a second PTAT signal from a portion of the second supply current, the portion of the second supply current corresponding to a constant ideality factor region of the second BJT; and outputting the reference voltage signal based on the first PTAT signal and the second PTAT signal, wherein the first plurality of BJTs and the second plurality of BJTs are positioned in an array, and at least one row or column of the array comprises two BJTs of the first plurality of BJTs and two BJTs of the second plurality of BJTs.

16. The method of claim 15, wherein at least one of:

generating the first PTAT signal comprises the portion of the first supply current having a value ranging from about 0.1 microampere (μA) to about 100 μA, or generating the second PTAT signal comprises the portion of the second supply current having a value ranging from about 0.1 μA to about 100 μA.

17. The method of claim 15, wherein at least one of:

generating the first PTAT signal comprises the portion of the first supply current having a value causing the ideality factor of the first BJT to be in a range from about 1.03 to about 1.07, or generating the second PTAT signal comprises the portion of the second supply current having a value causing the ideality factor of the second BJT to be in a range from about 1.03 to about 1.07.

18. The method of claim 15, wherein at least one of:

generating the first PTAT signal from the portion of the first supply current comprises dividing the first supply current among the first plurality of BJTs, or generating the second PTAT signal from the portion of the second supply current comprises dividing the second supply current among the second plurality of BJTs.

19. The method of claim 15, wherein at least one of:

generating the first PTAT signal comprises using the first BJT as a parasitic BJT of a p-type device including epitaxial SiGe, or generating the second PTAT signal comprises using the second BJT as a parasitic BJT of a p-type device including epitaxial SiGe.

20. The method of claim 15, wherein at least one of:

generating the first PTAT signal comprises using the first BJT as a parasitic BJT of an n-type device including epitaxial SiC, or generating the second PTAT signal comprises using the second BJT as a parasitic BJT of an n-type device including epitaxial SiC.

* * * * *